US008960172B2

(12) United States Patent
Ivanic et al.

(10) Patent No.: US 8,960,172 B2
(45) Date of Patent: Feb. 24, 2015

(54) PROJECTILE LAUNCHING DEVICE

(75) Inventors: Robert J. Ivanic, Saugus, CA (US); Tyler James Russell, Los Angeles, CA (US); Joseph Wong Wai Ching, Hong Kong (CN); Lee Ronald Loetz, Valley Village, CA (US)

(73) Assignee: Imperial Toy, LLC, North Hills, CA (US)

( * ) Notice: Subject to any disclaimer, the term of this patent is extended or adjusted under 35 U.S.C. 154(b) by 121 days.

(21) Appl. No.: 13/343,660

(22) Filed: Jan. 4, 2012

(65) Prior Publication Data

US 2013/0167818 A1 Jul. 4, 2013

(51) Int. Cl.
*F41B 3/00* (2006.01)

(52) U.S. Cl.
USPC ..... 124/5

(58) Field of Classification Search
USPC ..... 124/5
See application file for complete search history.

(56) References Cited

U.S. PATENT DOCUMENTS

| | | | | |
|---|---|---|---|---|
| 1,585,446 | A * | 5/1926 | Warwick | 124/5 |
| 3,049,352 | A * | 8/1962 | Hancock | 473/514 |
| 4,157,828 | A * | 6/1979 | Cosmopulos | 473/510 |
| 4,972,884 | A | 11/1990 | Souers et al. | |
| 7,686,001 | B2 * | 3/2010 | Fitt | 124/5 |
| 8,302,585 | B2 * | 11/2012 | FitzGerald | 124/5 |
| 2010/0018510 | A1 | 1/2010 | Shoaff | |

* cited by examiner

*Primary Examiner* — John Ricci
(74) *Attorney, Agent, or Firm* — Snell & Wilmer L.L.P.

(57) ABSTRACT

A launching device comprises a shaft having a first end and a second end, a head coupled to the first end of the shaft and a handle coupled to the second end of the shaft. The head comprises a cavity and a launch ramp curved both upwardly and outwardly from the cavity, wherein a distal portion of the launch ramp extends outwardly beyond the cavity in a forward launching direction. An angle is defined by the longitudinal grip axis and the distal portion of the launch ramp to direct a projectile disposed in the cavity in the forward launching direction.

18 Claims, 6 Drawing Sheets

PROJECTILE LAUNCHING DEVICE

FIELD OF THE INVENTION

This invention relates to a projectile launching device and, more particularly, to a projectile launching device that is particularly suited for launching water balloons at an intended target.

BACKGROUND

A water balloon or water bomb is a latex rubber balloon filled with water. Because of how water balloons' latex breaks under stress, they are often thrown and launched at targets, resulting in wetness. They are commonly used in water balloon fights and for purposes of carrying out practical jokes.

Water balloons are typically thrown or lobbed by a user at an intended target. Because water balloons, by nature, have an amorphous and changing shape, it is often difficult to accurately aim and throw a water balloon and actually hit an intended target. This difficulty is compounded when the intended target is located at a distance that is outside of one's throwing range.

Various devices have been developed to allow a user to throw water balloons at greater distances and hit the intended target at greater accuracy. One such device is a water balloon sling shot, which typically comprises a soft pocket in which the water balloon is placed, and an elastic material on either sides of the pocket. The Y-shaped frame, typical of the traditional slingshots, is usually omitted so as to accommodate a variety of water balloon shapes and sizes. As a result, the operation of a water balloon slingshot may require up to three people to launch a balloon, with two people holding the two ends of the elastic material and one person to retract the pocket and water balloon.

While there are other water balloon launchers that may require only a single person for operation, they are typically rather unwieldy or expensive. For example, there are launchers that make use of compressed air to push a water balloon out of a barrel, marketed under the name "Balloon Bazooka."

BRIEF SUMMARY

The embodiments of the launching devices disclosed herein overcome many of the drawbacks of known water balloon devices. It provides ease of operation in requiring only a single operator or user to launch the water balloons, while providing greater accuracy due to the configuration of the cavity in which the water balloon is held and the configuration of the launching surface from which it is propelled. Moreover, the launching device requires a simple range of motion in order to propel the water balloon towards its intended target. This simple range of motion may be either an overhead or underhand swing movement.

In one embodiment, a launching device comprises a shaft having a first end and a second end, a head coupled to the first end of the shaft and a handle coupled to the second end of the shaft. The head comprises a cavity and a launch ramp curved both upwardly and outwardly from the cavity, wherein a distal portion of the launch ramp extends outwardly beyond the cavity in a forward launching direction. An angle is defined by the longitudinal grip axis and the distal portion of the launch ramp to direct a projectile disposed in the cavity in the forward launching direction.

In accordance with a first aspect of the embodiment, the angle is greater than or equal to 90 degrees.

In accordance with a second aspect of the embodiment, the angle is in the range of from 110 to 170 degrees.

In accordance with a third aspect of the embodiment, the launch ramp has a radius of curvature that increases from the cavity to the distal portion.

In accordance with a fourth aspect of the embodiment, a proximal portion of the launch ramp adjacent the cavity is curved and the distal portion of the launch ramp is substantially planar.

In accordance with a fifth aspect of the embodiment, the shaft is angled relative to the grip axis so as to position the head at a distance away from the grip axis in a direction opposing the forward launch direction.

In accordance with a sixth aspect of the embodiment, a rolling surface is defined by the inner surface of the cavity and the launch ramp, wherein the rolling surface is specifically adapted to allow for the smooth rolling of a water balloon, and wherein the rolling surface is devoid of any protrusions or gaps which would create friction when the water balloon is rolled thereon.

In accordance with a seventh aspect of the embodiment, a guard member disposed alongside at least the grip section of the handle. The guard member may be configured to shield an entire side of the grip section in the forward launching direction.

In accordance with an eighth aspect of the embodiment, the launch ramp further includes a plurality of apertures.

In accordance with a ninth aspect of the embodiment, the launching device further comprises a looped member disposed on the handle.

In accordance with a tenth aspect of the embodiment, the cavity of the launching device is a pocket comprising walls that encircle a water balloon disposed therein.

In another embodiment, a launching device comprises a shaft having a first end and a second end, a head coupled to the first end of the shaft, and a handle coupled to the second end of the shaft. The head comprises a cavity and a curved launch ramp extending from the cavity and outwardly toward a forward launching direction. The handle comprises a grip section. The head is displaced at a distance away from the grip axis and in a direction opposing the launching direction.

In accordance with a first aspect of the embodiment, the cavity comprises an inner surface which is substantially smooth and devoid of any sharp edges.

In accordance with a second aspect of the embodiment, a rolling surface is defined by the inner surface of the cavity and the launch ramp, wherein the rolling surface is specifically adapted to allow for the smooth rolling of a water balloon, and wherein the rolling surface is devoid of any protrusions or gaps which would create friction when the water balloon is rolled thereon.

In accordance with a third aspect of the embodiment, the launch ramp has a radius of curvature that increases from the cavity to the distal portion.

In accordance with a fourth aspect of the embodiment, the shaft further comprises a curved shaft section between the first and second end, the curved launch ramp and the curved shaft section forming a sigmoidal curve.

In accordance with a fifth aspect of the embodiment, a guard member disposed alongside at least the grip section of the handle. The guard member may be configured to shield an entire side of the grip section in the forward launching direction.

In accordance with a sixth aspect of the embodiment, the launch ramp further includes a plurality of apertures.

In accordance with a seventh aspect of the embodiment, a looped member is disposed on the handle.

Other objects, features and advantages of the present invention will become apparent to those skilled in the art from the following detailed description.

BRIEF DESCRIPTION OF THE DRAWINGS

Illustrative embodiments of the present invention are described herein with reference to the accompanying drawings, in which.

Like numerals refer to like parts throughout the several views of the drawings.

DETAILED DESCRIPTION OF THE PREFERRED EMBODIMENTS

Figure 1:
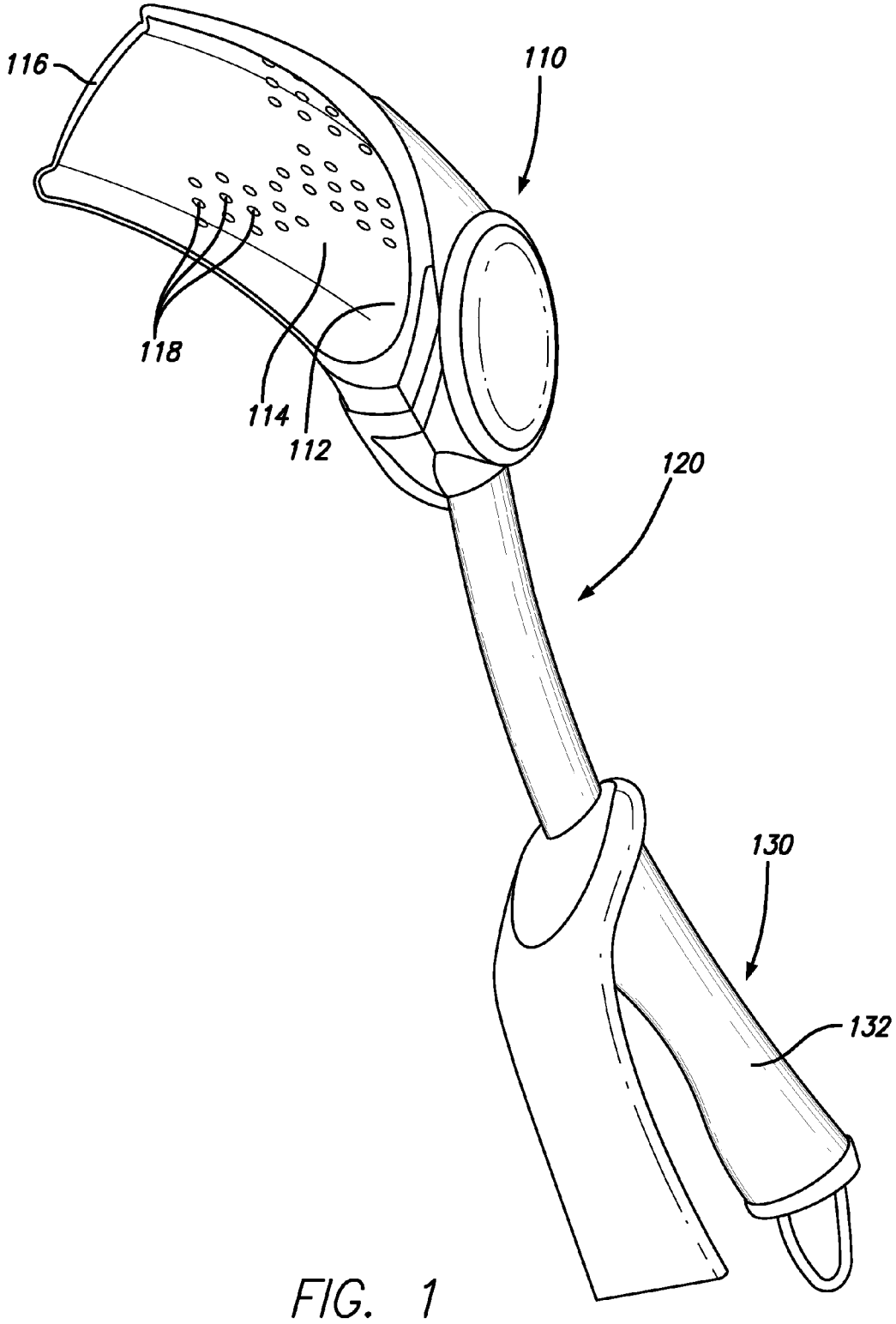
FIG. 1 is a perspective view of an embodiment of the launching device.
Figure 2:
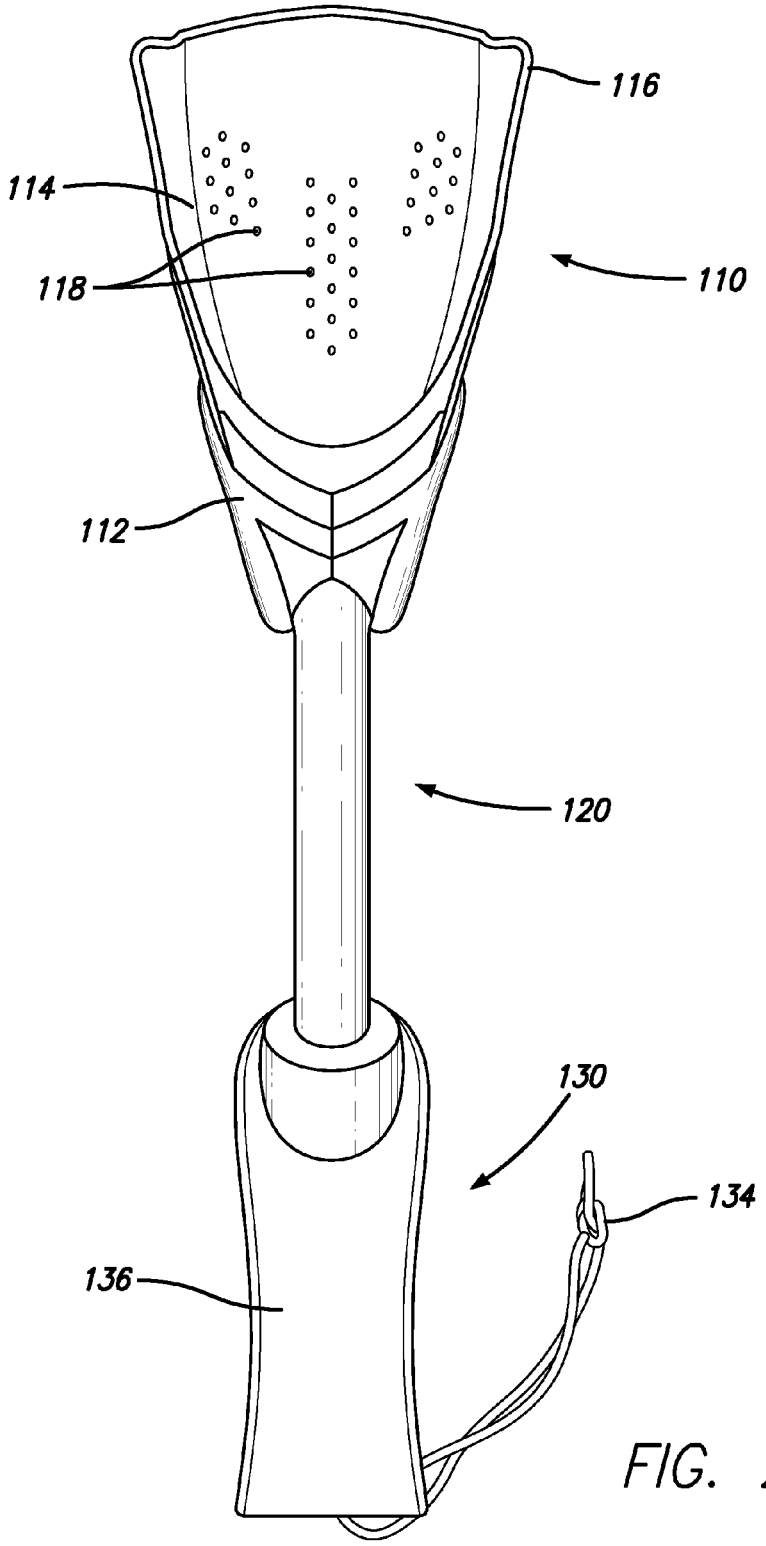
FIG. 2 is a front view of the launching device of FIG. 1.
Figure 3:
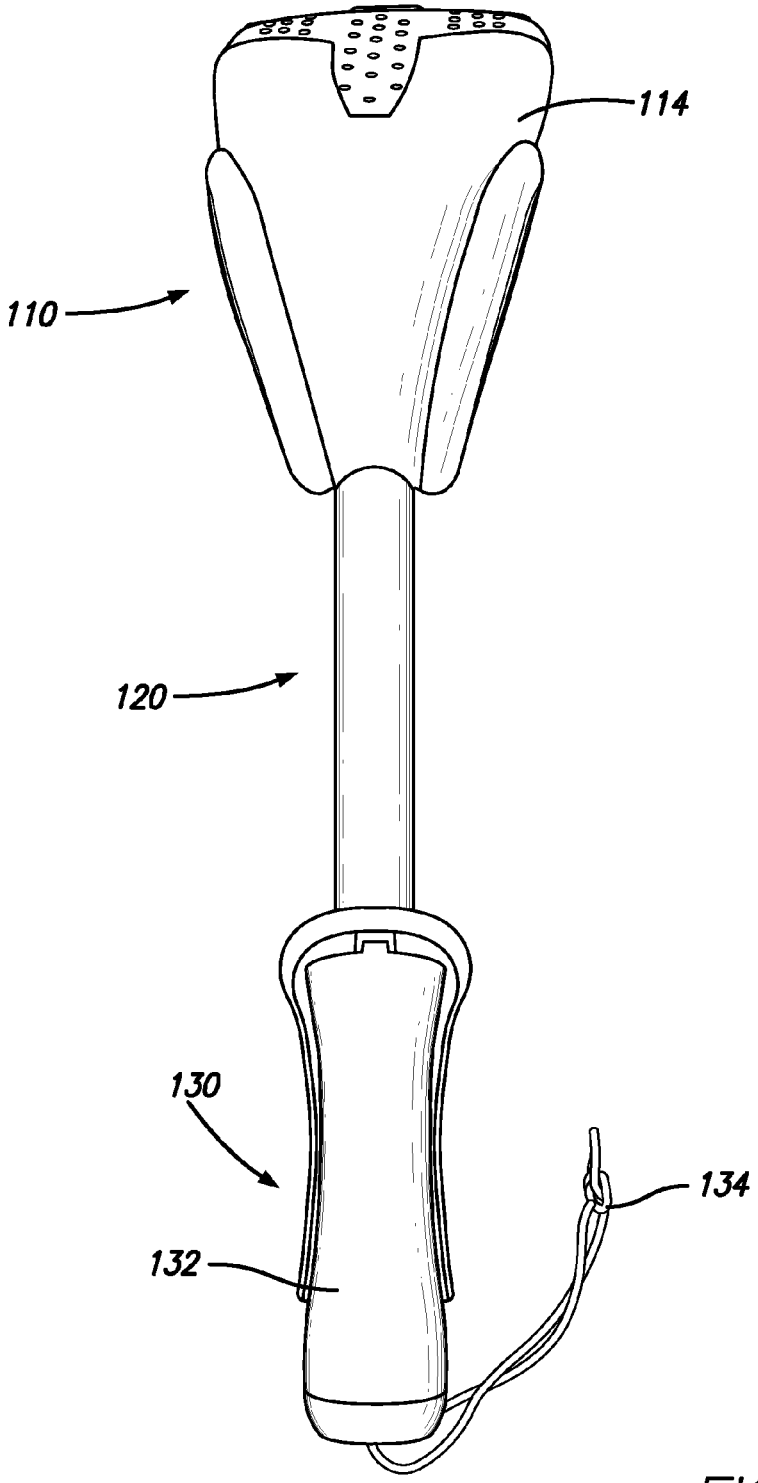
FIG. 3 is a rear view of the launching device of FIG. 1.

The embodiments of the launching device disclosed herein are designed to permit a single user to launch a projectile at an intended target. Various features of the launching device shown and described herein are configured to optimize both the accuracy, speed and distance with which a projectile, particularly a water balloon, is launched. While the launching device may be used to launch projectiles of a variety of sizes, dimensions, and weights, the launching device is specifically configured to be used in connection with launching water balloons.

Water balloons have certain features which make it particularly difficult to accurately hit an intended target that is located at a large distance away from the source. Water balloons, by their very nature, do not have a fixed shape may be rather amorphous. As a result, it is often difficult to be able to handle water balloons using one's own hands and throw them to hit an intended target, particularly when the water balloon must travel a large distance to reach the intended target.

In addition, water balloons are typically constructed from a thinner latex material to promote rupture upon impact. Thus, due to their fragile nature, water balloons are prone to rupturing prematurely, especially if it is not handled appropriately.

The launching devices disclosed here are specifically configured to prevent premature rupture of the water balloons while at the same time allowing the water balloons to be launched at a distance and speed greater than would be achieved by hand throwing.

FIGS. 1-4 depict an embodiment of the launching device comprising a head section 110, an elongated shaft 120 and a handle 130. The head section 110 comprises a cavity 112 which is configured and shaped to hold a water balloon (not depicted).

In one embodiment, the cavity 112 is an open pocket having walls that surround at least a portion, if not the entirety, of the water balloon. Preferably, the cavity 112 is configured such that in an upright position, the water balloon is maintained securely within the cavity 112. The cavity 112 may also have a curved or rounded surface without any sharp angles.

A launching ramp 114 extends both upwardly and outwardly along a launch axis which begins from the cavity and terminates in a distal portion 116 of the head section 110. The lateral or side surface of the launching ramp 114 may optionally be curved so as to maintain the water balloon along the launch axis. The launching ramp 114 may include a plurality of apertures 118 which reduces the drag or air resistance of the launching device as it is set into motion. The elongated shaft 120 comprises a first end coupled to the head section 110 and a second end that is coupled to the handle 130. The handle 130 generally comprises a grip section 132 having a longitudinal axis A-A (shown in FIG. 4). The handle 130 may optionally include a string loop 134 and guard member 136 to protect the user's hand when in use.

Figure 4:
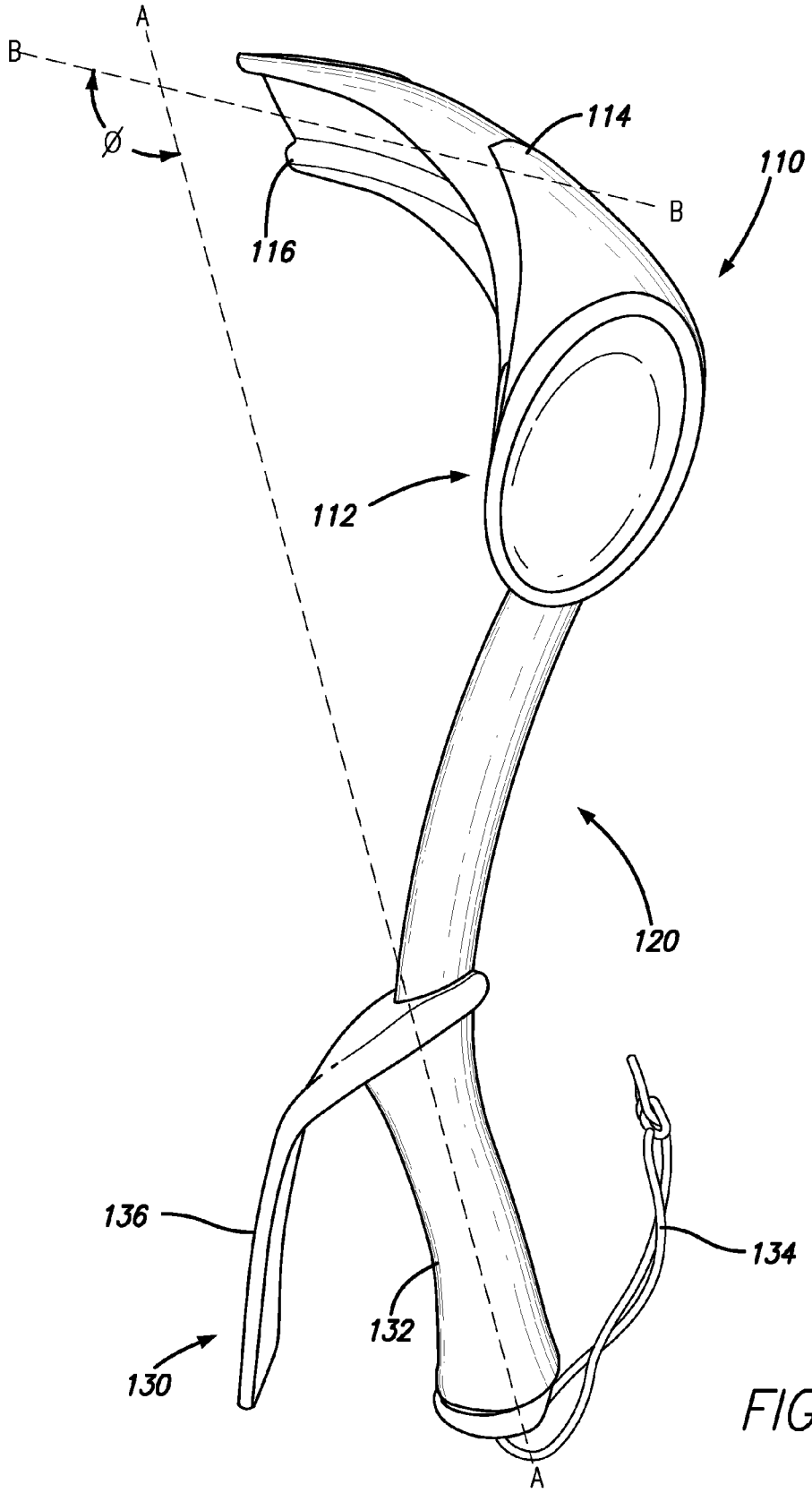
FIG. 4 is a side view of the launching device of FIG. 1.

In operation, a user may grasp the grip section 132 of the launching device with the head section 110 pointing upward. A water balloon or other projectile may be loaded into the cavity 112 and the water balloon may be launched out of the cavity by a forward rotational motion of the launching device, culminating in an abrupt stop or a flicking motion in a launching direction, as depicted in FIG. 4. The faster the forward rotational motion, the greater the velocity and distance traveled by the water balloon.

The launching device is configured so as to avoid premature rupture of the water balloon. In accordance with one embodiment, the surfaces contacting the water balloon during storage and launch are preferably smooth surfaces curved surfaces, devoid of sharp angles, edges or protrusions which may cause friction with the rolling of the water balloon.

Figure 5:
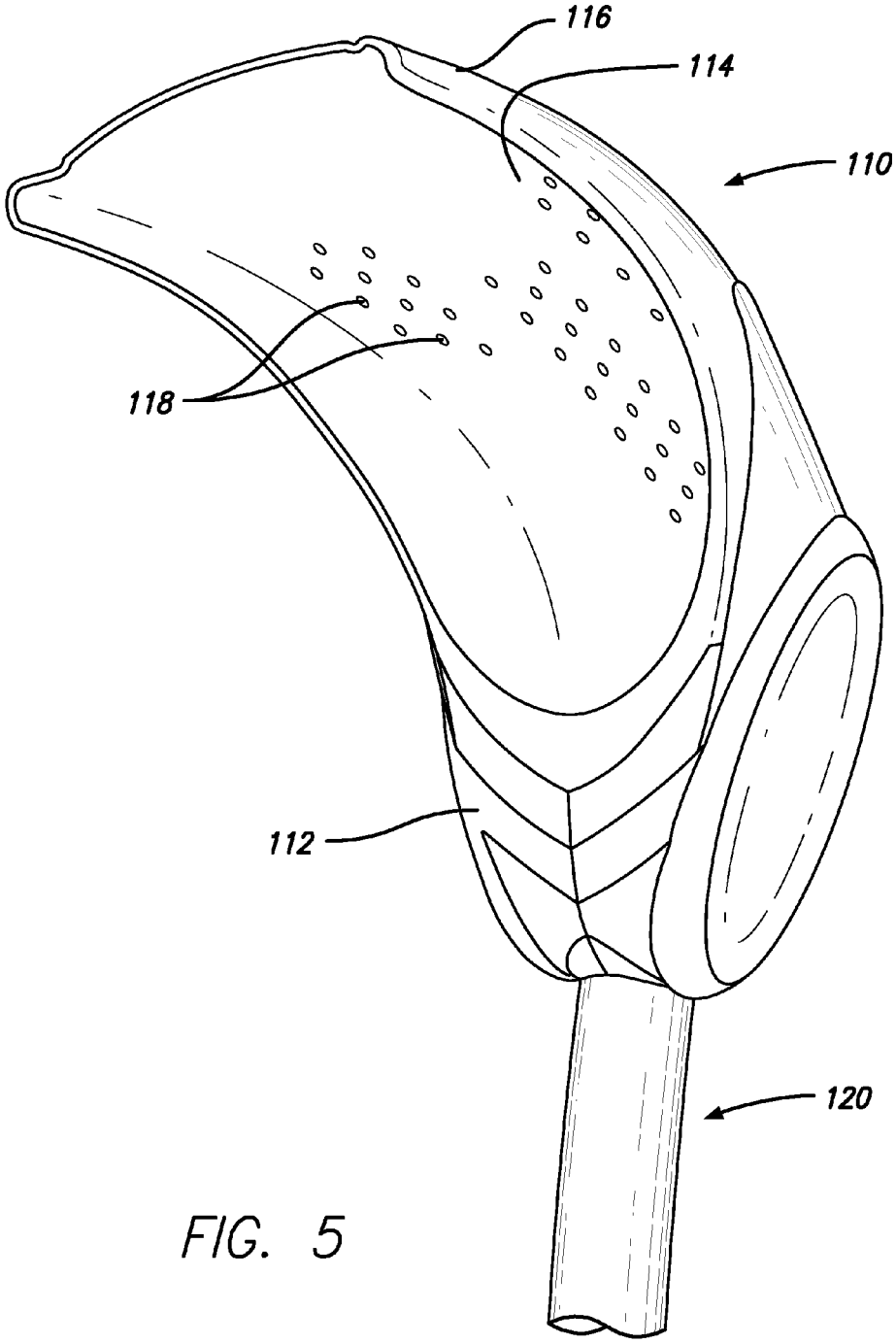
FIG. 5 is a perspective view of the head section of an embodiment of the launching device.
Figure 6:
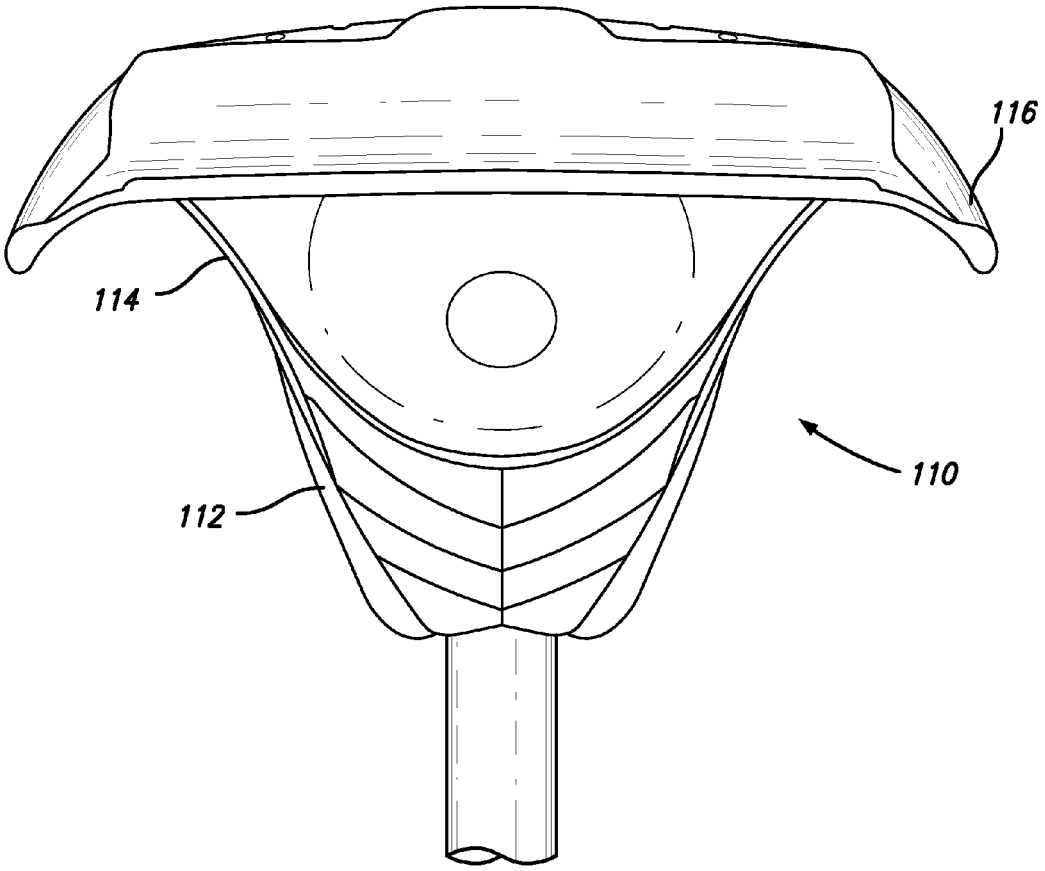
FIG. 6 is a top down view of the head section of the launching device of FIG. 5.

As shown in FIGS. 5-6, the head section 110 of the launching device comprises a cavity 112 which has a surrounding side wall and a bottom portion, thereby allowing for a water balloon to be seated securely within the cavity 112 when the launching device is held in an upright position as depicted in FIGS. 1-4.

A rolling surface is defined by the inner surface of the cavity 112 and the launch ramp 114. As shown in FIGS. 1-6, the launch ramp 114 is curved both upwardly and outwardly from the cavity 112 wherein a distal portion of the launch ramp extends outwardly beyond the cavity in a forward launching direction (see FIG. 4) along a launch axis. The rolling surface is specifically adapted to allow for the smooth rolling of the water balloon and the entirety of the rolling surface, again is devoid of sharp angles, edges or protrusions which would create friction when the water balloon is rolled thereon. While the rolling surface may include a plurality of apertures 118 to reduce wind resistance when the launching device is used, these apertures 118 are sufficiently small in size so as to not create significant friction. In a preferred embodiment, the largest diameter of the apertures is not greater than 10 mm, and preferably not greater than 5 mm.

The launching device is specifically configured to allow a user to accurately hit a target with a water balloon. Accordingly, the design of the launching device is not constrained so as to allow for the reciprocal "catching" of a projectile, although such may be accomplished.

As shown in FIG. 1-6, the distal portion 116 of the launch ramp 114 extends outwardly beyond the cavity 112 in a forward launching direction. While this may not be an optimal configuration for catching projectiles, it allows for a user to more accurately aim the water balloon at an intended target. In one embodiment, an angle θ is defined by the grip axis A-A and the distal portion 116 of the launch ramp 114 along axis B-B. In a preferred embodiment, the angle is greater than or equal to 90 degrees. In another preferred embodiment, the angle is in the range of from 110 to 170 degrees. In orienting the distal portion 116 of the launch ramp 114 relative to the grip axis A-A, the distal portion is configured so as to orient the exiting water balloon in a forward direction. In a preferred embodiment, proximal portion of the launch ramp 114 adjacent the cavity 112 is curved and the distal portion 116 has a substantially planar portion which defines the axis B-B from which the angle θ may be determined. In another preferred embodiment, the launch ramp 114 has a radius of curvature along its surface that increases from the proximal portion to the distal portion.

The launch device is also configured so as to maximize the speed at which the water balloon may be launched. To that end, the cavity 112 may be configured to be located at a distance away from the grip axis A-A and in a direction opposing the launching direction (see FIG. 4). In one preferred embodiment, the shaft 120 may comprise a curved shaft section between the first and second end such that the curved launch ramp and the curved shaft section form a sigmoidal curve. Such a configuration has the effect of increasing the distance and thus the angular momentum of the water balloon as it is thrown by the user. The angular momentum may further be increased by providing a longer shaft 130.

It is to be understood that the detailed description and specific examples, while indicating preferred embodiments of the present invention, are given by way of illustration and not limitation. Many changes and modifications within the scope of the present invention may be made without departing from the spirit thereof, and the invention includes all such modifications.

What is claimed is:

1. A launching device comprising:

a shaft having a first end, a second end;

a head coupled to the first end of the shaft, the head comprising a cavity and a launch ramp curved both upwardly and outwardly along a launch axis from the cavity wherein a distal portion of the launch ramp extends outwardly beyond the cavity in a forward launching direction, wherein a proximal portion of the launch ramp adjacent the cavity is curved and the distal portion of the launch ramp is substantially planar; and a handle coupled to the second end of the shaft, the handle comprising a grip section having a longitudinal grip axis;

wherein an angle is defined by the grip axis and the distal portion of the launch ramp.

2. The launching device of claim 1, wherein the angle is greater than or equal to 90 degrees.

3. The launching device of claim 2, wherein the angle is in the range of from 110 to 170 degrees.

4. The launching device of claim 1, wherein the launch ramp has a radius of curvature that increases from the cavity to the distal portion.

5. The launching device of claim 1, wherein the shaft is angled relative to the grip axis so as to position the head at a distance away from the grip axis in a direction opposing the forward launch direction.

6. The launching device of claim 1, wherein a rolling surface is defined by the inner surface of the cavity and the launch ramp, wherein the rolling surface is specifically adapted to allow for the smooth rolling of a water balloon, and wherein the rolling surface is devoid of any protrusions or gaps which would create friction when the water balloon is rolled thereon.

7. The launching device of claim 1, further comprising a guard member disposed alongside at least the grip section of the handle.

8. The launching device of claim 7, wherein the guard member shields an entire side of the grip section in the forward launching direction.

9. The launching device of claim 1, wherein the launch ramp further includes a plurality of apertures.

10. The launching device of claim 1, further comprising a looped member disposed on the handle.

11. The launching device of claim 1, wherein the cavity is a pocket comprising walls that encircle a water balloon disposed therein.

12. A launching device comprising:

a shaft having a first end and a second end;

a head coupled to the first end of the shaft, the head comprising a cavity and a curved launch ramp extending from the cavity and outwardly toward a forward launching direction, wherein the launch ramp has a radius of curvature that increases from the cavity to the distal portion; and a handle coupled to the second end of the shaft, the handle comprising a grip section; and wherein the head is displaced at a distance away from the grip axis and in a direction opposing the launching direction.

13. The launching device of claim 12, wherein the cavity comprises an inner surface which is substantially smooth and devoid of any sharp edges.

14. The launching device of claim 13, wherein a rolling surface is defined by the inner surface of the cavity and the launch ramp, wherein the rolling surface is specifically adapted to allow for the smooth rolling of a water balloon, and wherein the rolling surface is devoid of any protrusions or gaps which would create friction when the water balloon is rolled thereon.

15. The launching device of claim 12, wherein the shaft further comprises a curved shaft section between the first and second end, the curved launch ramp and the curved shaft section forming a sigmoidal curve.

16. The launching device of claim 12, further comprising a guard member disposed alongside at least the grip section of the handle.

17. The launching device of claim 16, wherein the guard member shields an entire side of the grip section in the forward launching direction.

18. The launching device of claim 12, wherein the launch ramp further includes a plurality of apertures.

* * * * *